US010624483B2

(12) United States Patent
Tricarico

(10) Patent No.: US 10,624,483 B2
(45) Date of Patent: Apr. 21, 2020

(54) SECURITY MAILBOX AND CONVERSION KIT

(71) Applicant: Steven J. Tricarico, Wheat Ridge, CO (US)

(72) Inventor: Steven J. Tricarico, Wheat Ridge, CO (US)

( * ) Notice: Subject to any disclaimer, the term of this patent is extended or adjusted under 35 U.S.C. 154(b) by 0 days.

(21) Appl. No.: 16/381,900

(22) Filed: Apr. 11, 2019

(65) Prior Publication Data

US 2019/0313827 A1 Oct. 17, 2019

Related U.S. Application Data

(60) Provisional application No. 62/656,245, filed on Apr. 11, 2018.

(51) Int. Cl.
*A47G 29/12* (2006.01)
*A47G 29/124* (2006.01)

(52) U.S. Cl.
CPC ..... *A47G 29/1209* (2013.01); *A47G 29/124* (2013.01)

(58) Field of Classification Search
CPC ..... A47G 29/1209; A47G 29/124; A47G 29/1245; A47G 29/126
USPC ..... 232/17, 38, 44, 45
See application file for complete search history.

(56) References Cited

U.S. PATENT DOCUMENTS 755,038 A * 3/1904 Palmer ..... A47G 29/1201 232/24
4,333,603 A * 6/1982 Carlson ..... A47G 29/1209 232/17
4,361,271 A 11/1982 Hester et al.
4,726,512 A * 2/1988 White ..... A47G 29/1209 232/17
5,586,718 A 12/1996 Speece
5,915,618 A * 6/1999 Gaudet ..... A47G 29/1209 232/17
6,318,628 B1 11/2001 Pangburn
6,808,108 B1 * 10/2004 Turnbow ..... A47G 29/1209 232/17
7,070,090 B2 7/2006 Ranen
(Continued)

FOREIGN PATENT DOCUMENTS

| | | |
|---|---|---|
| DE | 19630723 | 7/1996 |
| GB | 2463473 | 3/2010 |
| WO | WO2007139904 | 12/2007 |

*Primary Examiner* — William L Miller
(74) *Attorney, Agent, or Firm* — Spencer Fane LLP

(57) ABSTRACT

A security mailbox and associated field-modification kit having an interior security panel comprising a first lock member configured to engage a second lock member connected to the interior of the mailbox, a slot to deposit mail articles through the security panel, and a hinge piece to connect the security panel to the floor of the mailbox. The mailbox and kit includes a pulling member demountably connected between the front door and the security panel; whereby rotation of the front door imparts a pulling force via the pulling member sufficient to open the security panel when the security panel is unlocked. The mailbox and kit may alternatively include a spring member configured to rotate the security panel open when unlocked. The first lock member includes a door latch and spring latch to secure the security panel to the mailbox. The security mailbox and kit further includes reinforcing and installation hardware.

20 Claims, 15 Drawing Sheets

(56) References Cited

U.S. PATENT DOCUMENTS

| | | | | |
|---|---|---|---|---|
| 7,178,717 | B1 * | 2/2007 | Lindell | A47G 29/1209 232/45 |
| 7,931,189 | B2 | 4/2011 | Kalenburg | |
| 8,261,965 | B2 | 9/2012 | Cyphers et al. | |
| 8,616,436 | B2 | 12/2013 | Brewer | |
| 8,757,476 | B2 * | 6/2014 | Childress | A47G 29/1209 232/17 |
| 9,700,166 | B2 | 7/2017 | Farentinos et al. | |
| 10,111,548 | B1 * | 10/2018 | Dry | E06B 7/16 |
| 10,342,373 | B2 * | 7/2019 | Clark | A47G 29/122 |

* cited by examiner

SECURITY MAILBOX AND CONVERSION KIT

CROSS-REFERENCE TO RELATED APPLICATIONS

This application claims priority from U.S. Provisional Patent Application Ser. No. 62/656,245, filed Apr. 11, 2018, entitled "Mailbox Conversion Kit," which is herein incorporated by reference in its entirety.

BACKGROUND

1. Field of the Disclosed Subject Matter

The disclosed subject matter relates generally to mailboxes and more particularly, but not exclusively, to internal security panels of mailboxes.

2. Background

To protect against the risk of mail theft, some mailboxes are provided with an internal security panel having a slot that is large enough to generally accept letters and envelopes, but small enough to prevent a human hand from reaching into the interior of the mailbox to remove the mail items. The dimensions of the slot are not large enough to accept delivery of parcels having exterior dimensions exceeding the dimensions of the slot. As such, mail carriers cannot deliver a parcel that exceed the dimensions of the slot, and thus are required to complete delivery via alternate means. Existing mailboxes with internal security panels are susceptible to being pried opened because the walls of the mailbox proximate to the opening of the mailbox are not reinforced.

There is a need to provide a security mailbox and associated mailbox conversion kit that provides full access to the interior compartment of the mailbox without security credentials, and subsequently secures the interior compartment. In addition, there is a need to reinforce the walls of the mailbox proximate the opening of the mailbox to prevent forcible access to the interior compartment of the mailbox.

SUMMARY

The disclosed subject matter is directed towards a security mailbox and associated kit for field-modification of a mailbox to protect against mail theft, wherein the mailbox comprises a set of walls and a floor that define an opening at an end of the mailbox, wherein a front door is affixed to said mailbox proximate to the opening, the opening providing full access to the interior compartment of the mailbox when the front door is in an open position. In an embodiment, the kit including: (1) a security panel connected proximate to the opening; (2) at least one first securing member configured to connect the security panel to the floor; (3) a first lock member connected to the security panel opposite the floor; (3) a pulling member demountably coupled between the front door and the security panel, whereby the pulling member urges the security panel open when the front door is rotated away from the opening; (4) a second lock member connected to the set of walls proximate to the opening, the second lock member configured to interlock with the first lock member; and (5) at least one second securing member configured to connect the second lock member to the set of walls. Alternatively, the at least one first securing member and the at least one second securing member are replaced with welds.

In an embodiment, a security mailbox including a mailbox, wherein the mailbox comprises a set of walls and a floor that define an opening at an end of the mailbox, wherein a front door is affixed to said mailbox proximate to the opening, the opening providing full access to the interior compartment of the mailbox when the front door is in an open position; a security panel hingedly connected to the floor, the security panel comprising: a peripheral shape conforming to the interior dimensions of the opening defined by the set of walls and the floor; a first lock member connected to the security panel opposite the floor; and one of a spring member connected between the front door and floor, and a pulling member demountably coupled between the front door and the security panel; and a second lock member connected to an interior wall of the mailbox proximate to said opening, the second lock member configured to interlock with first lock member when the security panel is in a vertical position; wherein a secure interior compartment for receiving deposited mail articles is substantially bounded by the security panel, the set of walls, and the floor rearward of the security panel, thereby allowing substantially the full volume of the mailbox behind the security panel to hold deposited mail articles.

In an embodiment, the spring member includes one of an elongated spring disposed internal to a hinge piece connected between the security panel and floor, and a set of springs.

In yet another embodiment, the pulling member is connected to the front door, the pulling member is configured to engage the security panel through a slot in the security panel; whereby the security panel is urged open when the front door is opened.

In an embodiment, the security panel includes a peripheral shape conforming to the interior dimensions of the opening defined by the set of walls on the floor. In another embodiment, the security panel comprises a slot extending through the security panel, the slot configured to receive mail articles such as envelopes, but sized to resist removal of said articles front the interior compartment. The security panel includes a hinge piece adapted to hingedly connect the security panel to the floor proximate the opening; whereby the security panel is rotated through the opening to access the interior compartment of the mailbox. In an embodiment the hinge piece is spring-loaded and configured to rotate the security panel towards the front door. In another embodiment, a set of spring members are connected between the security panel and floor, the set of spring members are configured to rotate the security panel towards the front door.

In an embodiment, the first lock member is configured to abut the second lock member but not interlock with each other when the front door is closed. In this configuration, the security panel may be urged open by the pulling member without any security credentials to the first lock member. In an embodiment, the first lock member includes a security access point configured to unlock the security panel. The security access point includes at least one of a key lock, a combination lock, and an electronic pin pad.

In an embodiment, the pulling member is connected to one of an interior surface of the front door and an exterior surface of the security panel. The pulling member may comprise a magnetic member that demountably couples the front door to the security panel; whereby the security panel is urged open when the front door is opened.

In an embodiment, the pulling member is connected to the front door and includes a bracket extending through a slot in the front door. The bracket configured to engage the security panel when the front door is opened. In an embodiment the bracket includes a tab proximate a bottom edge of the front door, the bracket configured a pre-determined length to assist in the engagement with the security panel.

In an embodiment the slot is bounded by a set of tabs extending away from the interior surface of the security panel. The tabs assist in theft deterrence by providing additional physical barriers against a accessing the interior compartment of the mailbox.

In an embodiment, the kit includes a reinforcing band configured to connect to the set of walls and the floor proximate the opening in order to provide additional structural rigidity to the mailbox. In an embodiment, the reinforcing band includes a set of flat sections configured to connect between the security panel and the floor. In an embodiment, the set of flat sections are configured to interlock with each other in order resist physical separation.

In another embodiment, the security mailbox and kit includes a bottom plate connected between at least one of the security panel and the reinforcing band. The bottom plate abuts a front edge of the floor to provide additional rigidity to the floor proximate to the opening.

In another embodiment, the first lock member includes a spring latch and a door latch, each configured to engage the second lock member. In an embodiment the second lock member comprises a first edge and second edge in parallel arrangement with the first edge. The first edge configured to engage the spring lock when the security panel is rotated to a vertical position; thereby locking the security panel. The second edge configured to interlock with the door latch when the security panel is rotated into a vertical position; thereby restraining vertical movement between the security panel and the set of walls. In an embodiment, the second lock member is connected to the band, or alternatively, to the set of walls.

An embodiment of a method of a using a field-modified mailbox includes providing a field-modified mailbox, wherein the mailbox comprises a set of walls and a floor that define an opening at an end of the mailbox, wherein a front door is affixed to said mailbox proximate to the opening, the opening providing full access to the interior compartment of the mailbox when the front door is in an open position, wherein the conversion kit comprising: a security panel comprising a peripheral shape conforming to the interior dimensions of the opening defined by the set of walls and the floor, and a hinge piece comprising a first hinge portion adapted to be connected to the floor of the mailbox proximate to the opening, and a second hinge portion hingedly coupled to a first edge of the security panel, wherein the security panel provides access to the interior compartment of the mailbox through rotation of the hinge piece; at least one first securing member configured to connect the first hinge portion to the floor; a first lock member connected to the security panel proximate a second edge opposite the first edge of the security panel; a pulling member demountably coupled between the front door and the security panel, whereby the pulling member urges the security panel open when the front door is moved away from the opening; a second lock member connected to an interior wall of the mailbox proximate to said opening, the second lock member configured to interlock with first lock member when the security panel is in a vertical position; and at least one second securing member for securing the second lock member to the set of walls. The method further includes positioning the first lock member of the security panel adjacent to the second lock member; wherein the first lock member does not interlock with the second lock member. The method further includes closing the front door, whereby the pulling member demountably connects the security panel and the front door. The method further includes opening the front door, thereby opening the security panel by means of the pulling member connected between the front door and the security panel.

Another embodiment of a method of a using a field-modified mailbox includes closing the security panel with a force sufficient to interlock the first lock member to the second lock member, thereby securing an interior compartment of the mailbox.

Another embodiment of a method of a using a field-modified mailbox includes unlocking the first lock member with a security credential; and opening the security panel; thereby accessing the interior compartment of the mailbox.

In some embodiments, a method of using a security mailbox includes providing a security mailbox comprising a mailbox comprising: a set of walls and a floor that define an opening at an end of the mailbox, wherein a front door is affixed to said mailbox proximate to the opening, the opening providing full access to the interior compartment of the mailbox when the front door is in an open position; a security panel hingedly connected to the floor, the security panel comprising a peripheral shape conforming to the interior dimensions of the opening defined by the set of walls and the floor; a spring member connected between the front door and floor, the spring member configured to rotate the security panel towards the front door when unlocked, wherein the security panel provides access to the interior compartment of the mailbox through rotation of the security panel through the opening; and a first lock member connected to the security panel opposite the floor; and a second lock member connected to an interior wall of the mailbox proximate to said opening, the second lock member configured to interlock with first lock member when the security panel is in a vertical position.

In another embodiment, the method further includes: positioning the first lock member of the security panel adjacent to the second lock member; wherein the first lock member does not interlock with the second lock member; closing the front door, whereby the security panel abuts the front door through rotation of the security via the spring member; opening the front door, whereby the security panel rotates open by means of the spring member rotating the security panel towards the front door and through the opening; closing the security panel with a force sufficient to interlock the first lock member to the second lock member, thereby securing an interior compartment of the mailbox; unlocking the first lock member with a security credential; opening the security panel; thereby accessing the interior compartment of the mailbox.

An objective of the security mailbox, mailbox conversion kit and methods is to provide an improved security mailbox. Another objective of the security mailbox, mailbox conversion kit and methods is to provide a tamper resistant mailbox where the interior compartment of the mailbox may first be conveniently accessed without security credentials and subsequently locked.

BRIEF DESCRIPTION OF THE DRAWINGS

The drawings constitute a part of this specification and include exemplary embodiments of the disclosed subject matter and illustrate various objects and features thereof.

DETAILED DESCRIPTION

Figure 1:
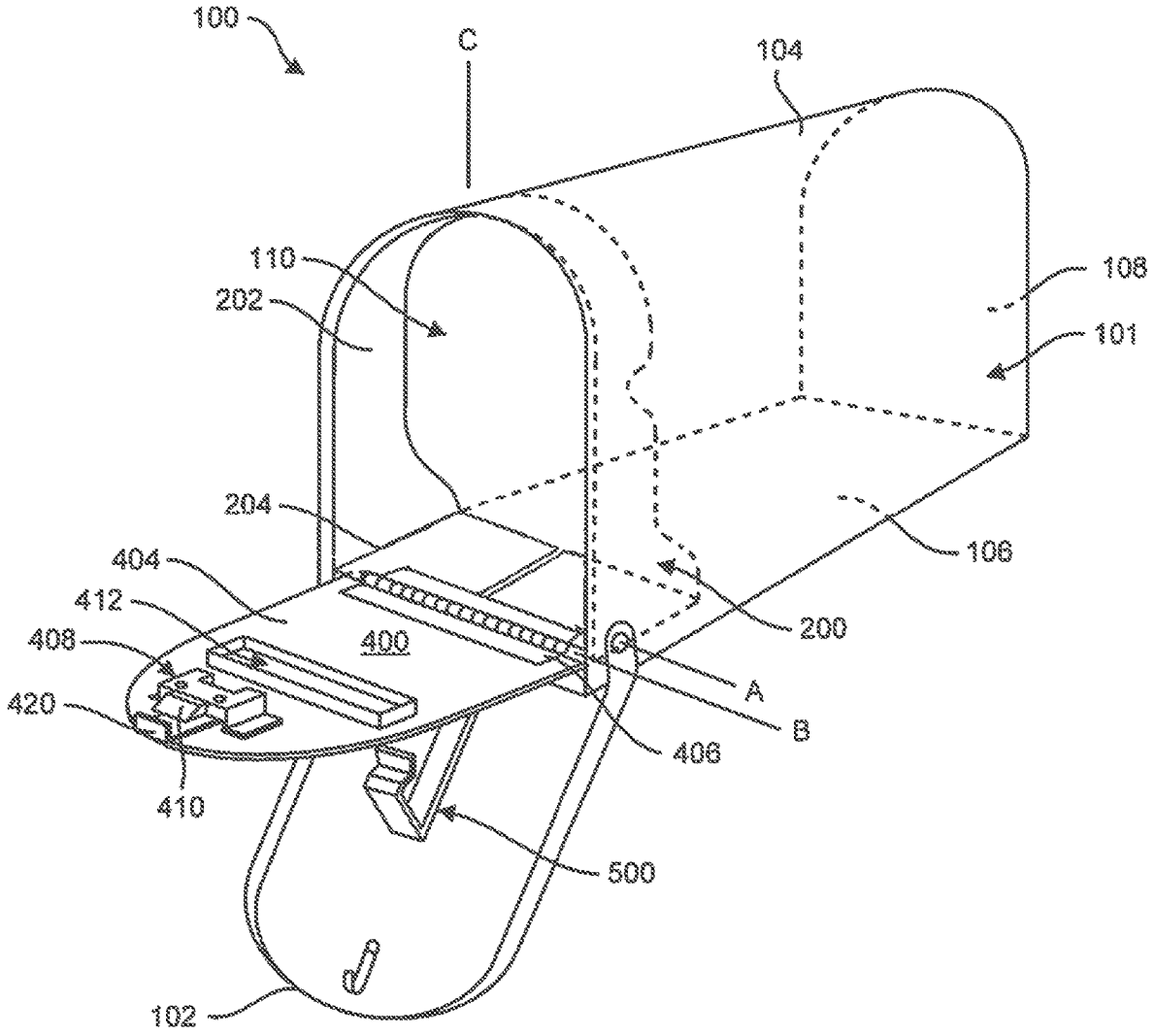
FIG. 1 is an isometric view of an embodiment of the disclosed subject matter.

As required, detailed aspects of the disclosed subject matter are disclosed herein; however, it is to be understood that the disclosed aspects are merely exemplary of the disclosed subject matter, which may be embodied in various forms. Therefore, specific structural and functional details disclosed herein are not to be interpreted as limiting, but merely as a basis for the claims and as a representative basis for teaching one skilled in the art how to variously employ the disclosed technology in virtually any appropriately detailed structure.

The detailed description includes the disclosure of numerical ranges. Numerical ranges should be construed to provide literal support for claim limitations reciting only the upper vale of a numerical range, and provide literal support for claim limitations reciting only the lower value of a numerical range.

Certain terminology will be used in the following description, and are shown in the drawings, and will not be limiting. For example, up, down, front, back, right and left refer to the disclosed subject matter as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

Although the invention has been disclosed with reference to various particular embodiments, it is understood that equivalents may be employed and substitutions made herein without departing from the scope of the invention as recited in the claims.

The disclosed subject matter will now be described with reference to the drawing figures, in which like reference numerals refer to like parts throughout. For purposes of clarity in illustrating the characteristics of the present disclosed subject matter, proportional relationships of the elements have not been maintained in the drawing figures. In some cases, the sizes of certain small components have been exaggerated for illustration.

FIGS. 1-4 illustrate an embodiment of the disclosed subject matter comprising a mailbox 100 having a security panel 400 in accordance with the principles of the disclosed subject matter. The security panel 400 is adapted for installation in a mailbox 100 of conventional pole-mounted design or factory installed with the mailbox. Alternative mailboxes and kits, based on the principles of the disclosed subject matter, can be adapted for construction and installation in mailboxes having different shapes. The mailbox 100 includes an interior compartment 101 bounded by a non-locking front door 102, a set of walls 104, a back wall 108, and a floor 106. The set of walls 104 and the floor 106 define an opening 110 at an end of the mailbox 100 opposite the back wall 108. The front door 102, configured to engage the set of walls 104, rotates forwardly and away from the set of walls 104 about an axis A.

The security panel 400 having a peripheral shape conforming to the interior dimensions of the opening 110 defined by the set of walls 104 and floor 106 of the mailbox 100, wherein the opening 110 provides full access to the interior compartment 101 of the mailbox 100 when the security panel 400 is rotated about an axis B. The security panel 400 having an interior surface 404 and an exterior surface 402, comprises a slot 412 suitable for mail pieces to be inserted through the security panel 400 and into the interior compartment 101; and a first lock member 408 to secure the security panel 400 to the set of walls 104 of the mailbox 100. In an embodiment of the disclosed subject matter, the first lock member 408 comprises a spring latch 410 that engages a first locking portion 212 of a second lock member 208, the second lock member 208 attached to the set of walls 104 of the mailbox 100. In another embodiment the second lock member is attached to a stiffening plate 214 (shown in FIG. 5). In an embodiment, the first lock member 408 comprises a security access point 409 configured to unlock the security panel. In some embodiments, the security access point 409 comprises a key lock, a combination lock, or an electronic pin pad. A security credential, such as a key or numerical code, is required to unlock the security panel 400 via the security access point 409.

The security panel 400 and band 200 may be constructed of steel, rubber, fiberglass, plastic, or other suitable material. In a preferred embodiment of the disclosed subject matter, the security panel 400 may be constructed of 18 gauge steel and the band 200 is constructed of 20 gauge steel.

In an embodiment of the disclosed subject matter, a door latch 420 is attached to the interior surface 404 of the security panel 400. The door latch 420 is configured to engage a second locking portion 210 (shown in FIG. 5) of the second lock member 208 or a second edge 528 (show in FIG. 10B). When the door latch 420 is engaged with the second locking portion 210, or alternatively the second edge 528, the second lock member 208 resists movement away from the security panel 400 along a vertical axis C of the security panel 400, thereby increasing the rigidity and theft-resistance of the mailbox 100.

In an embodiment of the disclosed subject matter, the security panel 400 is connected to the floor 106 with a hinge piece 406; the hinge piece 406 having a first hinge portion 406*a* adapted to be connected to the floor 106, and a second hinge portion 406*b* adapted to be hingedly connected to the security panel 400. In an embodiment of the disclosed subject matter, the first hinge portion 406*a* comprises a first set of holes 407 disposed along the length of the first hinge portion 406*a*. In an embodiment of the disclosed subject matter, the first hinge portion 406*a* is connected to the floor 106 using at least one first securing member such as, by way of example, self-taping sheet metal screws, nuts, and/or bolts; wherein the at least one first securing member is disposed through the first set of holes 407. In another embodiment, the first hinge portion 406*a* is welded to the floor 106. In an embodiment of the disclosed subject matter, the second hinge portion 406*b* of the hinge piece 406 is secured to security panel 400 using welds, self-taping sheet metal screws, nuts, and/or bolts.

Figure 2:
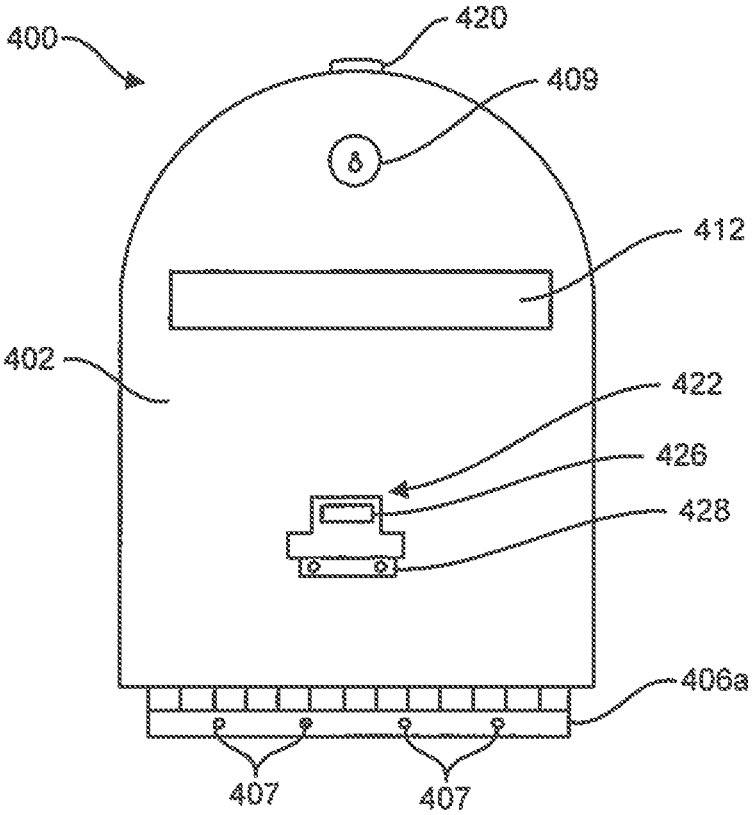
FIG. 2 is a front view of an embodiment of the disclosed subject matter.
Figure 4:
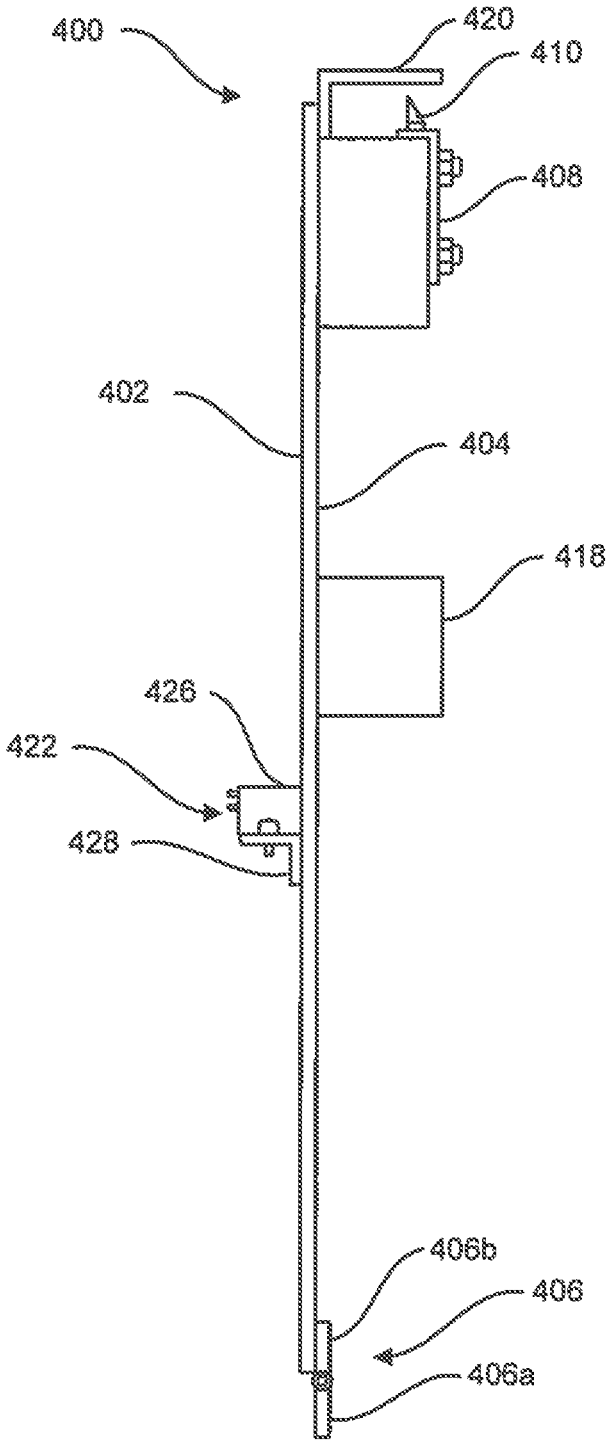
FIG. 4 is a side view of an embodiment of the disclosed subject matter.

In an embodiment of the disclosed subject matter, referring to FIGS. 2 and 4, the panel 400 further comprises a pulling member 422 attached to the exterior surface 402 of the security panel 400. The pulling member 422 is configured to demountably connect to the front door 102 by magnetic or mechanical means (such as a magnet or clip) so that when the front door 102 is opened, the security panel 400 is pulled opened simultaneously. In other embodiments of the disclosed subject matter, the pulling member 422 is attached to an interior side of the front door 102 and is configured to demountably connect to the security panel 400. As such, the security panel 400 may be rotated open by opening the front door 102.

In an embodiment, the pulling member 422 is configured to push the security panel 400 into a vertical position when the front door 102 is closed, thereby locking the interior compartment 101 of the mailbox 100 by engagement of first lock member 408 to the second lock member 208.

Referring the FIGS. 2 and 4, in an embodiment of the disclosed subject matter, the pulling member 422 comprises a magnetic member 426 connected to the exterior surface 402 via a pulling bracket 428. The magnetic member 426 is positioned to demountably connect to the interior surface of the front door 102 when the security panel 400 and front door 102 are in close proximity to each other. In other embodiments, the magnetic member 426 and pulling bracket 428 are connected to the front door.

Figure 3:
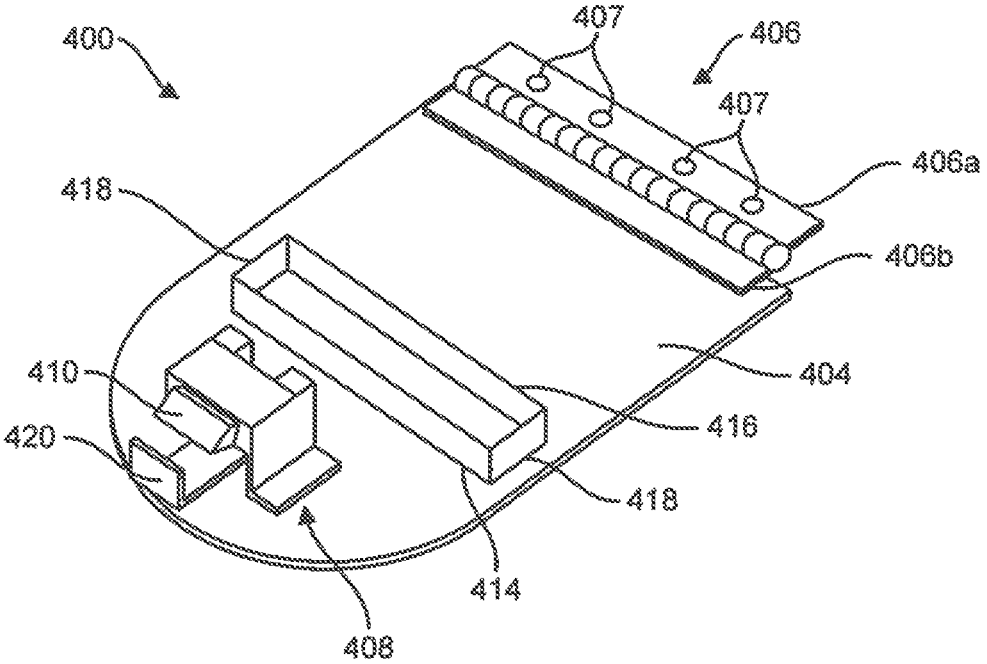
FIG. 3 is an isometric view of an embodiment of the disclosed subject matter.

Referring to FIGS. 3 and 4, the slot 412 is defined by a top tab 414, a bottom tab 416 disposed opposite the top tab 414, and side tabs 418 connected between the top tab 414 and the bottom tab 416. The tabs 414, 416 and 418 extend away from and are perpendicular to the interior surface 404 of the security panel 400 in order to deter theft of mail items placed in the interior compartment 101 of the mailbox 100. In an embodiment of the disclosed subject matter, the tabs extend away from the interior surface 404 about at least 0.5 inches. The tabs 414, 416 and 418 may be constructed of steel, rubber, fiberglass, plastic, or other suitable material. In a preferred embodiment of the disclosed subject matter, the tabs 414, 416 and 418 is constructed of 18 gauge steel.

Figure 5:
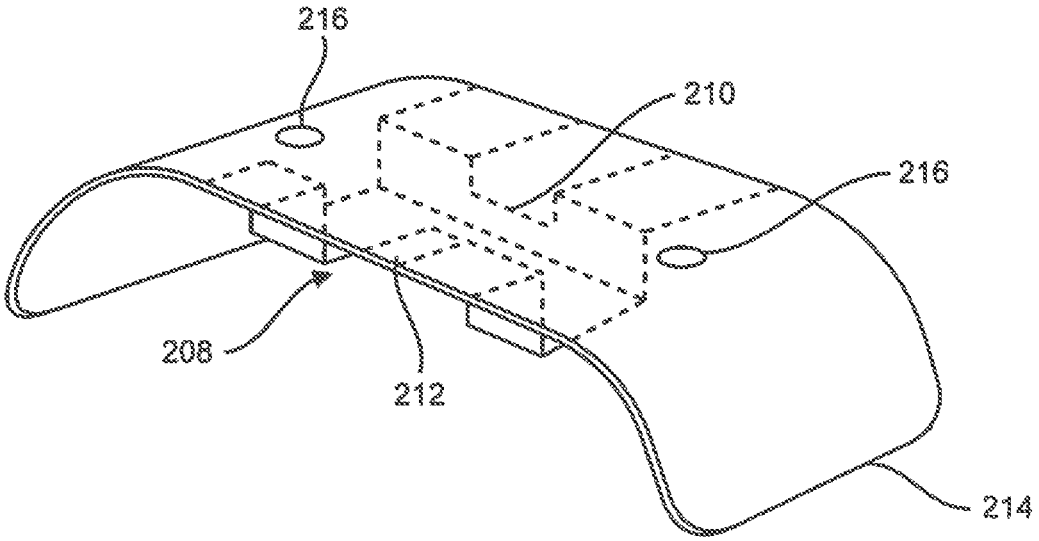
FIG. 5 is an isometric view of an embodiment of the disclosed subject matter.

Referring to FIG. 5, in an embodiment of the disclosed subject matter, the second lock member 208 is connected to at least one of a stiffening plate 214, the reinforcing band 200, and the set of walls 104. The second lock member 208 comprises a first locking portion 212 adapted to interlock with the spring latch 410; and a second locking portion 210 adapted to interlock with the door latch 420; whereby the security panel 400 is locked to the set of walls 104 when the security panel 400 is moved to a generally vertical position; and whereby the door latch 420 restrains the set of walls 104 of the mailbox 100 to the security panel 400.

Figure 6A:
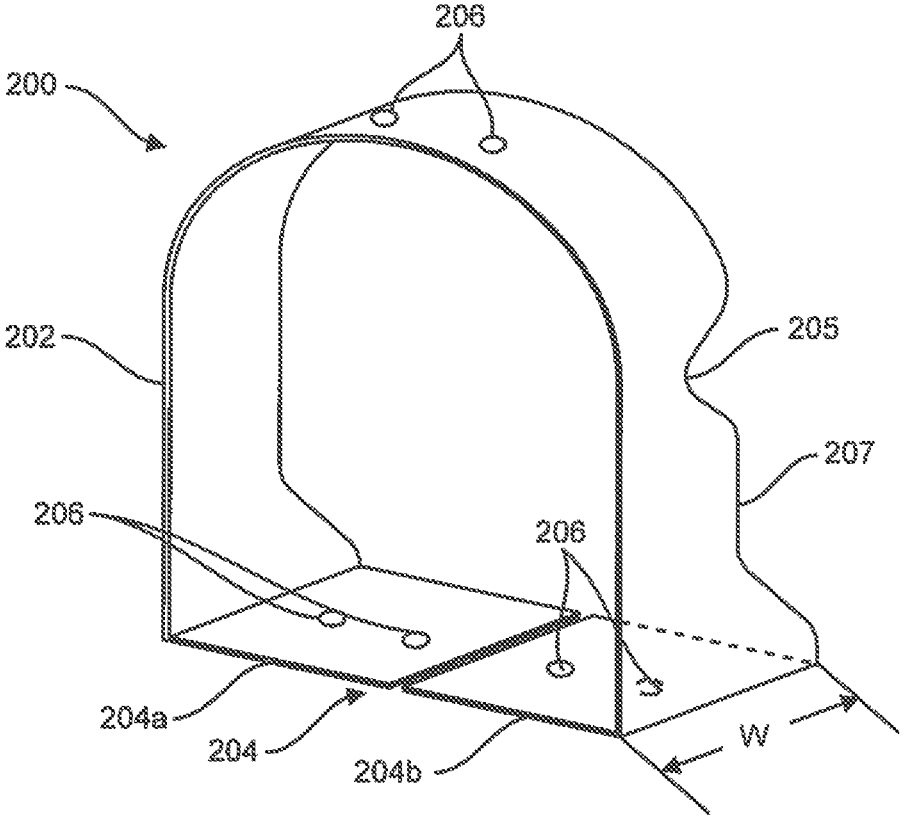
FIG. 6A is an isometric view of an embodiment of the disclosed subject matter.
Figure 6B:
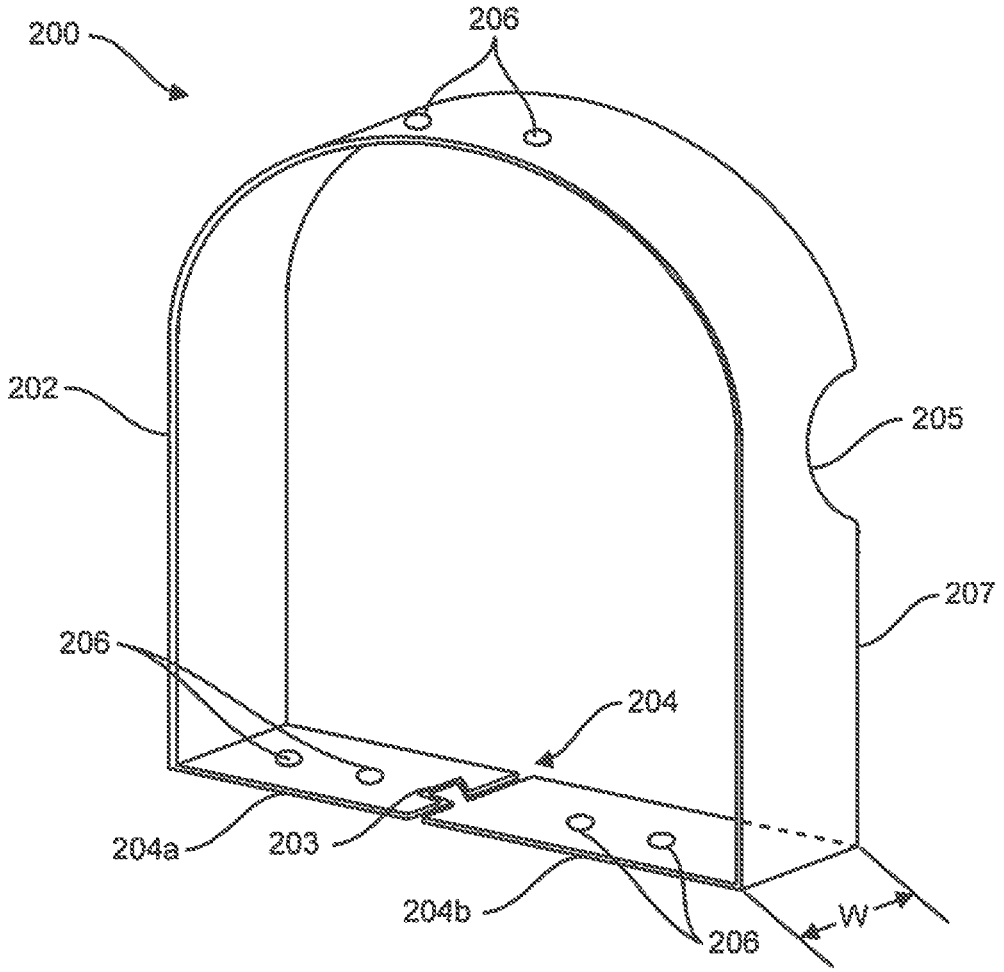
FIG. 6B is an isometric view of an embodiment of the disclosed subject matter.

The stiffening plate 214 further comprises a second set of holes 216 configured to align with at least one of a third set of holes 206 in the band 200 (show in FIGS. 6A and 6B). The stiffening plate 214 may be attached directly to the set of walls 104, or alternatively to the reinforcing band 200. The second lock member 208 and the stiffening plate 214 may be constructed of steel, rubber, fiberglass, plastic, or other suitable material. In a preferred embodiment of the disclosed subject matter, the second lock member 208 and stiffening plate 214 is constructed of 18 gauge or 20 gauge steel.

Referring to FIGS. 6A and 6B, in a preferred embodiment of the disclosed subject matter, a reinforcing band 200 is configured to snuggly fit to the interior dimensions of the mailbox 100 proximate the opening 110 in order to improve structural rigidity to the mailbox 100. The improved structural rigidity of the mailbox 100 provided by the reinforcing band 200 assists in maintaining the original shape of the mailbox 100 and helps prevent forcible entry into the interior compartment 101 through separation of the first lock member 408 from the second lock member 208. In an embodiment, the reinforcing band 200 comprises: a curved section 202 configured to snuggly fit to the interior of the set of walls 104; and a set of flat sections 204 connected to the curved section 202, the set of flat sections 204 configured to connect to the floor 106. In some embodiments, the set of flat sections 204 comprise two halves 204*a,b* in order to allow for deformation of the curved section 202 during installation of the band 200 into the interior compartment 101. Referring to FIG. 6B, in an embodiment, opposing edges of the set of flat sections 204 comprise a dovetail pattern 203 configured to interlock opposing edges of the two halves 204*a,b*. In an embodiment, the third set of holes 206 is configured to assist in connecting the band 200 to the mailbox 100 with at least one second securing member such as, by way as example, nuts, bolts and/or screws. In an alternate embodiment, the third set of holes 206 and the at least one second securing member may be eliminated and the band is secured to the mailbox through use of welds.

In an embodiment, the width W of the band 200 may vary to accommodate pre-existing interior hardware of the mailbox 100. In a preferred embodiment, the band 200 comprises a notch 205 along the rearward facing perimeter 207 to accommodate mounting hardware for attachment of accessories to the exterior of the mailbox, such as a mail flag. As illustrated in FIG. 6A, in some embodiments, the reward facing perimeter extends rearwardly proximate the floor 106 to provide additional rigidness to the mailbox 100 near the floor of the mailbox. In some embodiment of the disclosed subject matter, the band varies in width from about 2 inches to 5 inches. In other embodiments, and referring to FIG. 6B, the band 200 maintains a constant width W and is between about 2 inches to 5 inches wide, and preferably about 2 inches wide.

Figure 7A:
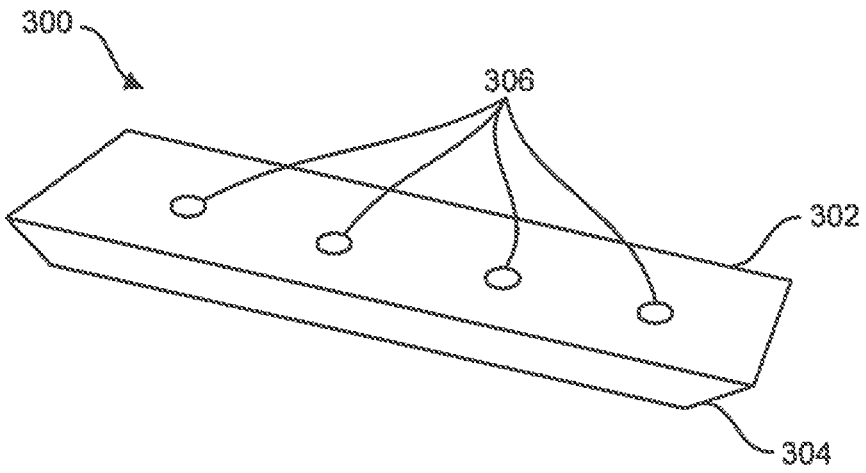
FIG. 7A is an isometric view of an embodiment of the disclosed subject matter.
Figure 7B:
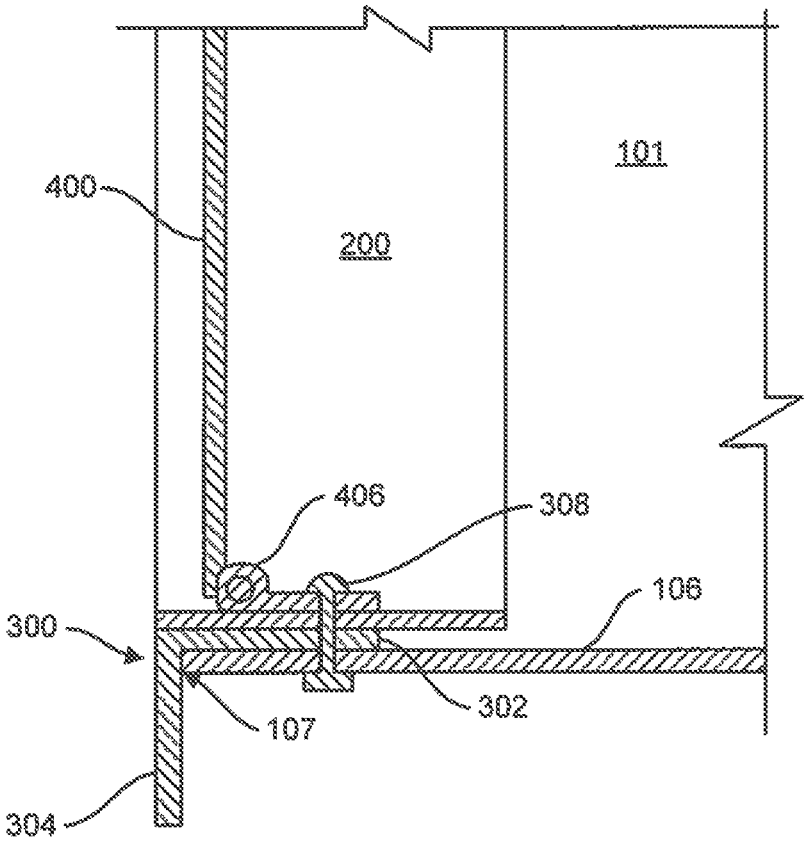
FIG. 7B is cross-sectional view of an embodiment of the disclosed subject matter.

Referring to FIGS. 7A and 7B, in a preferred embodiment of the disclosed subject matter, the rigidity of the mailbox 100 may be increased with the installation of a bottom plate 300 comprising: a first bottom member 302 having a fourth set of holes 306; and a second bottom member 304 connected to the first bottom member 302 at approximately a right angle. The bottom plate is configured to extend between opposing side walls of the mailbox. In an embodiment, the first bottom member 302 is configured to connect between the reinforcing band 200 and the floor 106. By securing the bottom plate 300 proximate the front door 102 of the mailbox 100, the stiffness of the floor 106 is increased near the opening 110, thereby reducing the chance that the security panel 400 will be pried open. The second bottom member 304 is configured to abut a front peripheral edge 107 of the floor 106 and extend downwardly from the opening of the mailbox 100. In an embodiment, the at least one first securing member 308 is utilized to secure the bottom plate 300 to the floor 106. The bottom plate 300 may be constructed of steel, rubber, fiberglass, plastic, or other suitable material. In a preferred embodiment of the disclosed subject matter, the bottom plate 300 may be constructed of 18 gauge or 20 gauge steel.

Figure 8A:
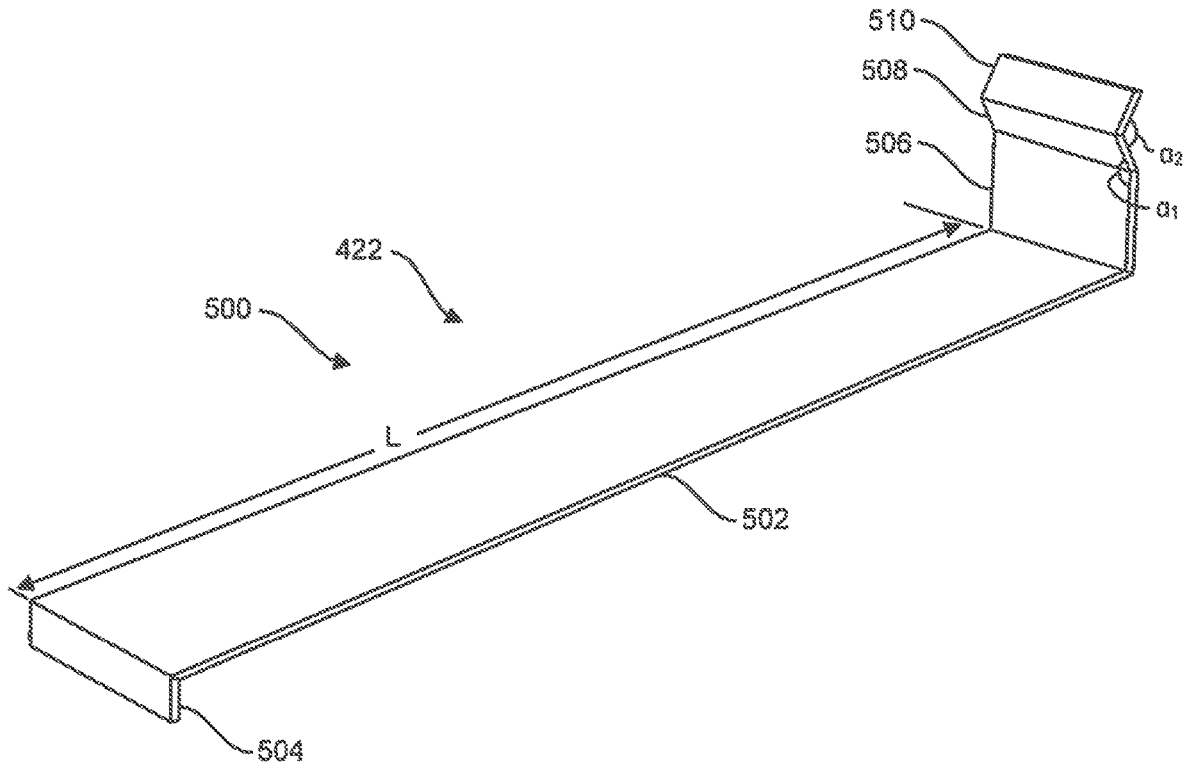
FIG. 8A is an isometric view of an embodiment of the disclosed subject matter.
Figure 8B:
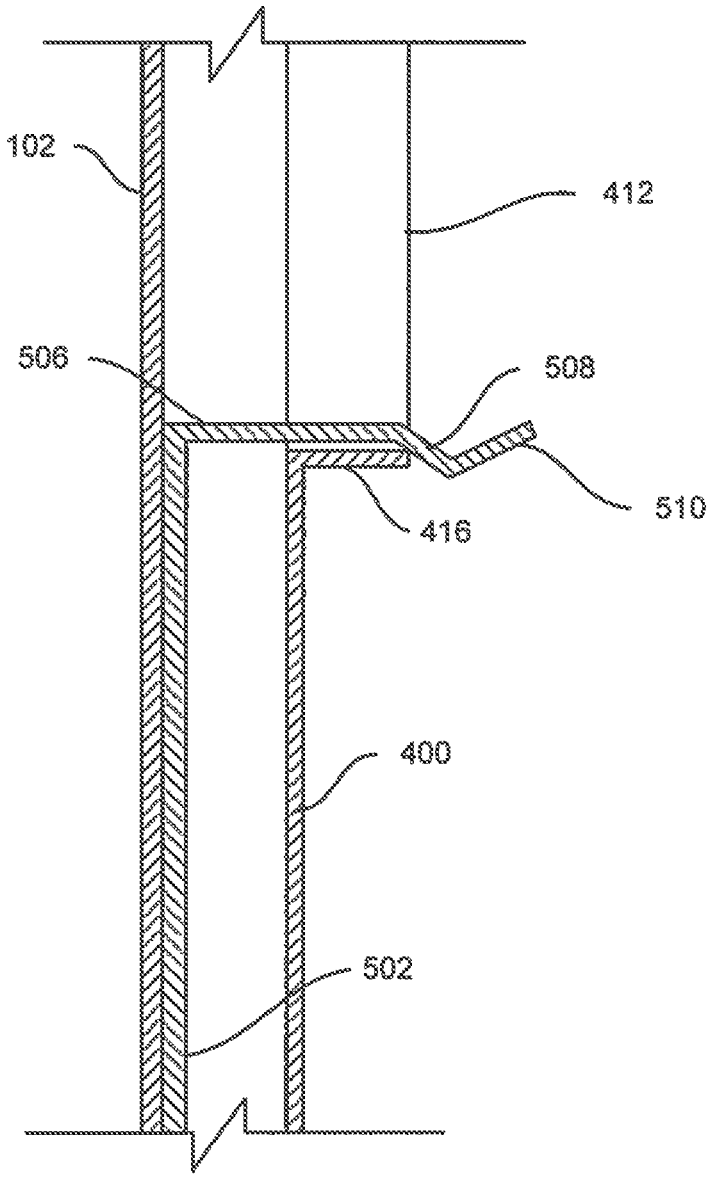
FIG. 8B is a cross-sectional view of an embodiment of the disclosed subject matter.

Referring to FIGS. 8A and 8B, the pulling member 422 is connected to the front door 102, and the pulling member is configured to engage the security panel 400 through a slot 412 in the security panel 400; whereby the security panel 400 is urged open when the front door 102 is opened. In an embodiment of the disclosed subject matter, the pulling member 422 comprises a bracket 500 to engage the security panel and urge the security panel open. The bracket 500 comprising a first bracket member 502 connected to the front door 102. The bracket comprises a tab 504 connected to a first distal end of the first bracket member 502; the tab 504 configured to abut a bottom edge of the front door 102. The first bracket member 502 comprises a length L configured to position a second bracket member 506 a predetermined distance from the bottom edge of the front door 102. The second bracket member 504 is generally perpendicular to the first member 502 and extends away from the front door 102. A third bracket member 508 is connected to the second bracket member 506 opposite the first bracket member 502. The third bracket member 508 extends outwardly and away from the second bracket member 506, forming a first obtuse angle $\alpha_1$ about 150 degrees between the second bracket member 506 and third bracket member 508. A fourth bracket member 510 is connected to the third bracket member 508 opposite the second bracket member 506. The fourth bracket member 510 extends outwardly and away from the third bracket member 508, forming a second obtuse angle $\alpha_2$ of about 120 degrees between the third bracket member 508 and the fourth bracket member 510.

The third bracket member 508 is configured to engage the bottom tab 416 of the slot 412; whereby the third bracket member 508 urges the security panel 400 open when the front door 102 is opened. The bracket 500 is configured to disengage from the bottom tab 416 when the front door 102 and security panel 400 are rotated at least 20 degrees from vertical. The bracket 500 may be constructed of steel, rubber, fiberglass, plastic, or other suitable material. In a preferred embodiment of the disclosed subject matter, the bracket 500 is constructed of 18 gauge or 20 gauge steel.

Figure 9:
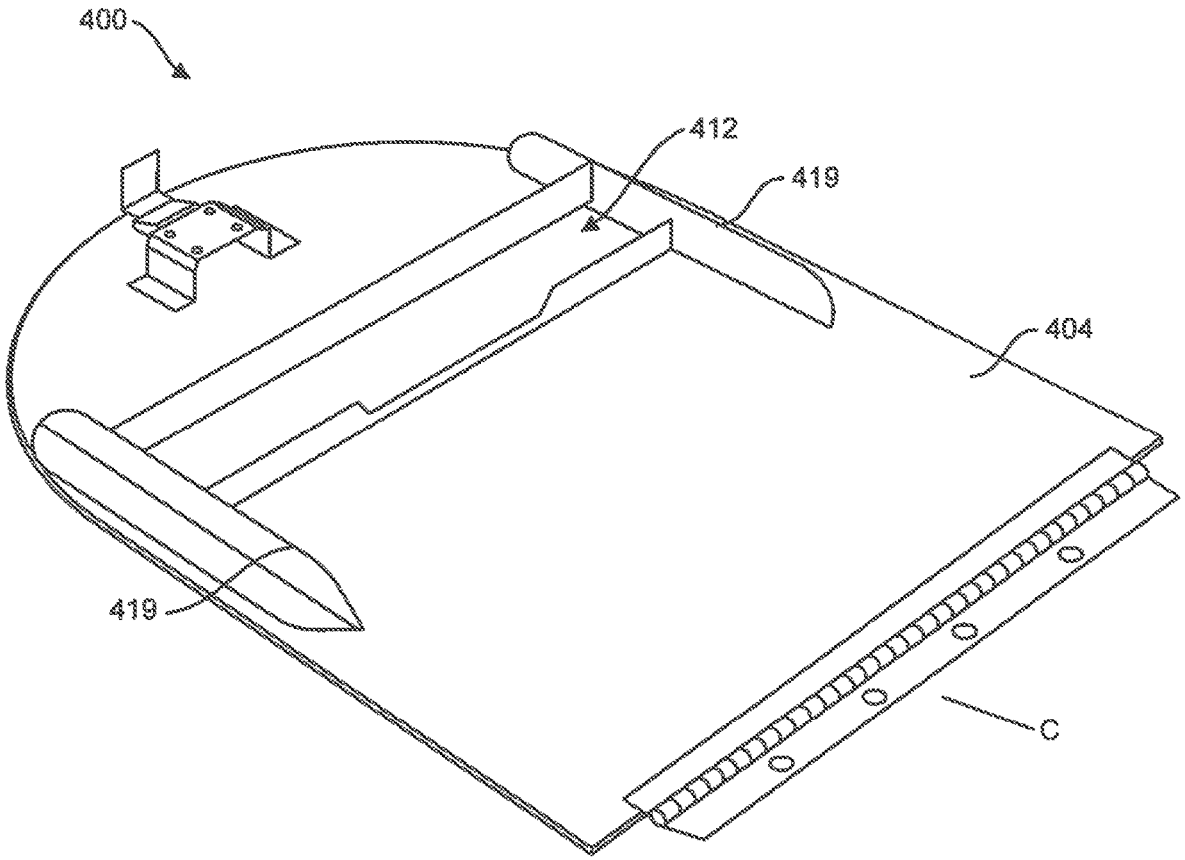
FIG. 9 is an isometric view of an embodiment of the disclosed subject matter.

Referring to FIG. 9, in an embodiment of the disclosed subject matter, the side tabs 418 (shown in FIG. 3) are replaced with side angles 419 extending upwardly and downwardly away from the slot 412 parallel to vertical axis C of the security panel 400. The side angles 419 are configured to attached to the interior surface 404 of the security panel in order to provide addition rigidity to the security panel 400.

Figure 10A:
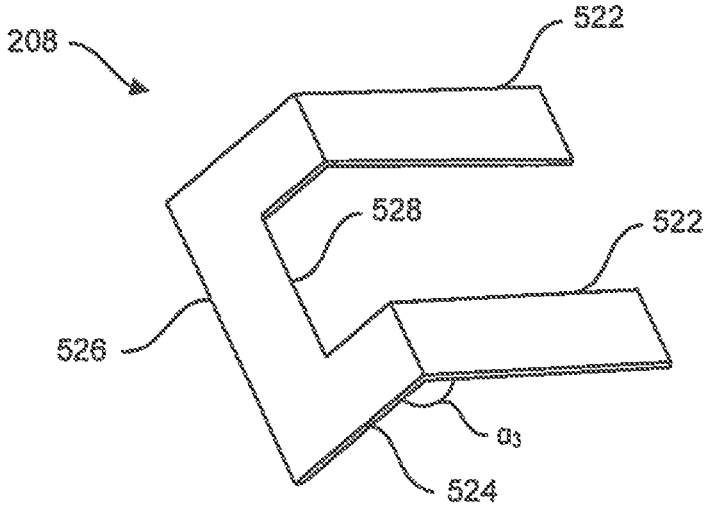
FIG. 10A is a schematic view of an embodiment of the disclosed subject matter.
Figure 10B:
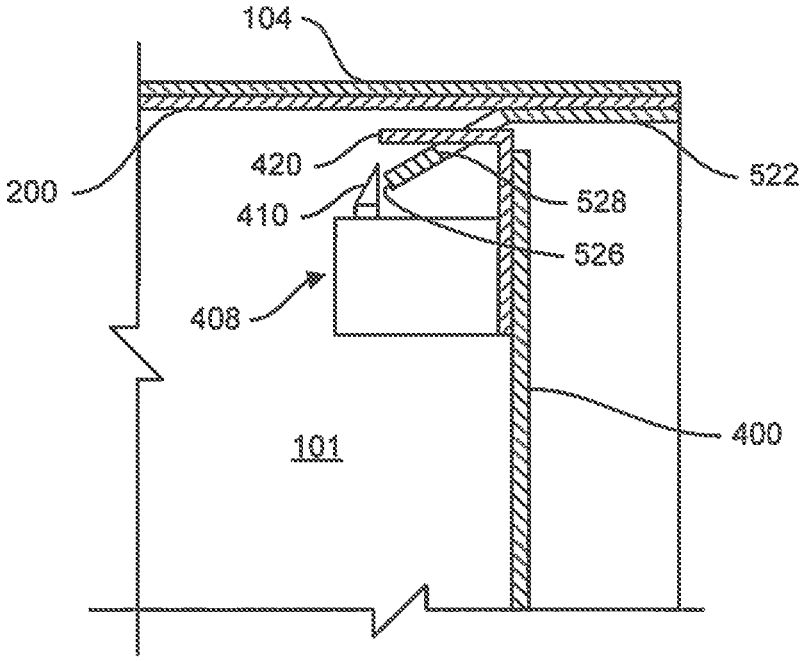
FIG. 10B is a cross-sectional view of an embodiment of the disclosed subject matter.

Referring to FIGS. 10A and 10B, in an alternate embodiment the second lock member 208 comprises a pair of tabs 522 configured to connect to at least one of the reinforcing band 400 and the set of walls 104. The second lock member 208 further comprises a u-shaped member 524 attached to the pair of tab 522. The u-shaped member 524 having a first edge 526 and a second edge 528 in parallel arrangement with the first edge 526. The u-shaped member 524 extending downwardly and away from the pair of tabs 522 at an obtuse angle $\alpha_3$ between about 120 and 160 degrees, and preferably about 140 degrees. The first edge 526 is configured to interlock and restrain the first lock member 408 via the spring latch 410; and wherein the second edge 528 is configured to interlock with the door latch 420 and retrain the set of walls 104 to the security panel 400.

Figure 11A:
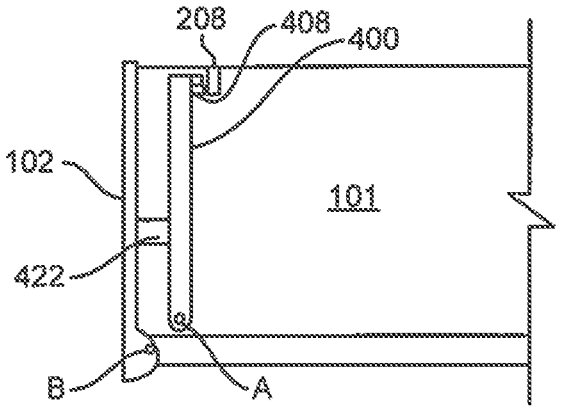
FIG. 11A is a schematic view of an embodiment of the disclosed subject matter.
Figure 11B:
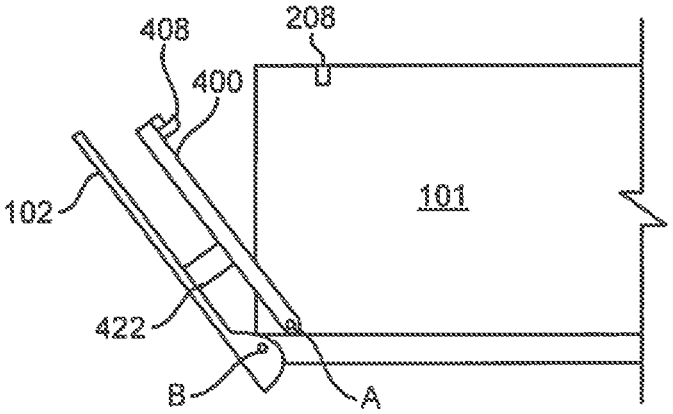
FIG. 11B is a schematic view of an embodiment of the disclosed subject matter.
Figure 11C:
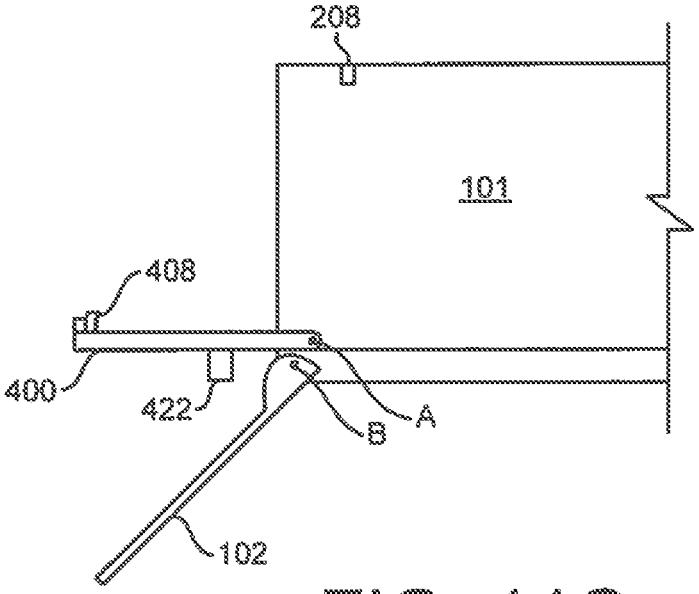
FIG. 11C is a schematic view of an embodiment of the disclosed subject matter.

In an embodiment and referring to FIGS. 11A-C, in FIG. 11A the security panel 400 is shown in a first position wherein the first lock member 408 abuts the second lock member 208 but does not interlock with the second lock member 208. The front door 102 is shown in a closed position and the pulling member 422 engages both the front door 102 and security panel 400. The pulling member 422 may be one of a magnetic member 426 (as shown in FIGS. 2 and 4) and a bracket 500 (as shown in FIGS. 8A and 8B). In this first position, the user has prepared the mailbox 100 so that the mail carrier may access the interior compartment 101 of the mailbox 110 without a security credentials, such as a key or a combination code, to the first lock member 408.

Referring to FIG. 11B, the security panel 400 is shown in a second position wherein the front door 102 has rotated downward about axis B. The downward rotation of the front door 102 imparts a pulling force upon the security panel 400 by means of the pulling member 422, whereby the security panel 400 is rotated downwardly about axis A, thus exposing the interior compartment 101 of mailbox 100.

Referring to FIG. 11C, the security panel is shown in a third position wherein the security panel 400 has rotated to about a horizontal position and the front door 102 had rotated past horizontal, thereby disengaging the pulling member 422 from the front door 102. FIG. 11C illustrates the pulling member 422 attached to the security panel 400; however, the pulling member 422 may alternately be attached to the front door 102.

Figure 11D:
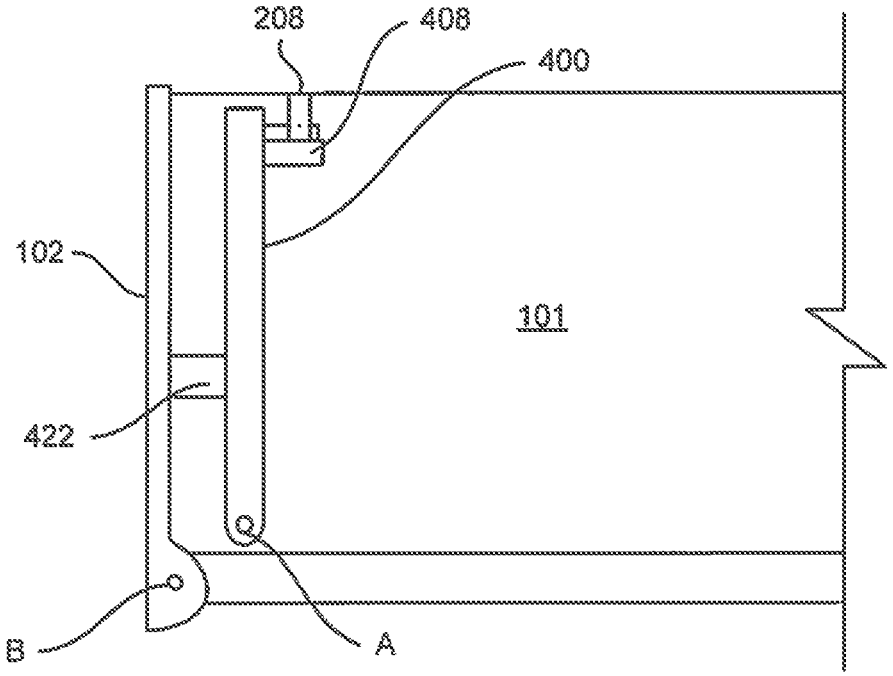
FIG. 11D is a schematic view of an embodiment of the disclosed subject matter.

Referring to FIG. 11D, the security panel is illustrated in an fourth position wherein the first lock member 408 interlocks with the second lock member 208; thereby locking the security panel 400 to mailbox 100, and securing the interior compartment 101.

Figure 12A:
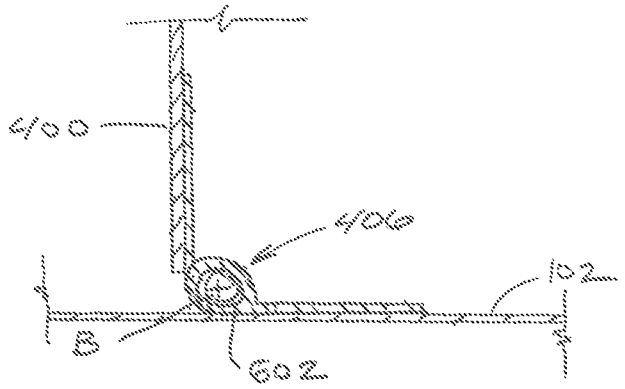
FIG. 12A is a cross-sectional view of an embodiment of the disclosed subject matter.
Figure 12B:
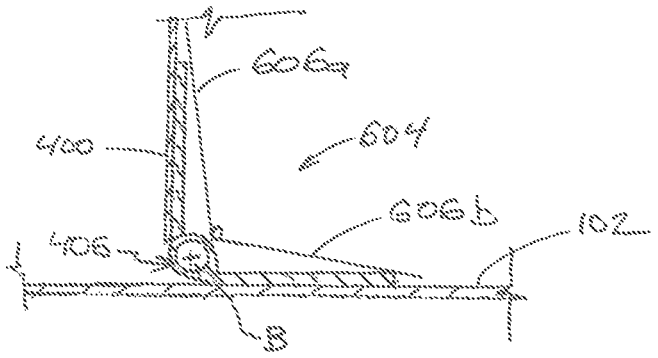
FIG. 12B is a cross-sectional view of an embodiment of the disclosed subject matter.
Figure 12C:
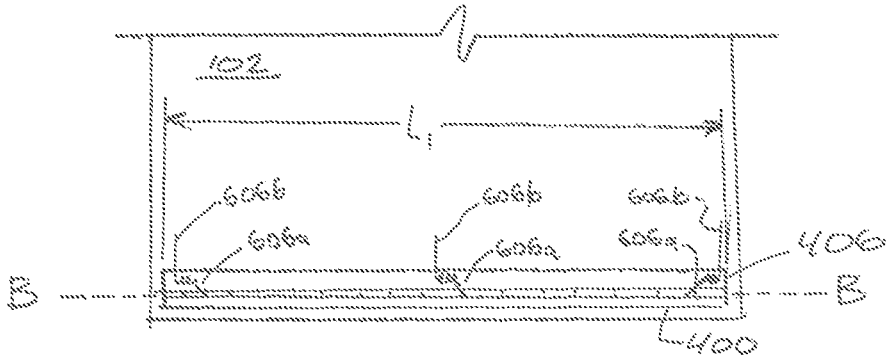
FIG. 12C is a plan view of an embodiment of the disclosed subject matter.

Referring to FIGS. 12A-C, in some embodiment of the disclosed subject matter, the hinge piece 406 comprises a spring member configured to rotate the security panel towards the front door about the axis B. Referring to FIG. 12A, in an embodiment of the disclosed subject matter, the spring member comprises an elongated spring 602 disposed internal to the hinge piece 406 along axis B. The elongated spring 602 is pre-tensioned and configured to rotate the security panel open along about axis B. Referring to FIGS. 12B and 12C, in an embodiment of the disclosed subject matter, the spring member comprises a set of springs 604 connected between the security panel 400 and the floor 102. Each set of springs 604 comprises a pair of spring arms 606*a,b* disposed opposite each other and configured to apply a rotating force to security panel about the axis B. The sectional view of FIG. 12B illustrates the pair of arms

606*a,b* engaging the security panel 400 and the floor 102. The top view of FIG. 12C illustrates the set of springs 606 disposed along the length $L_1$ of hinge piece 406. Through use embodiments of the spring member as described above, the pulling member 422 is not required to rotate open the security panel.

Method of Field Modification

An embodiment of a method of field modification of a mailbox to protect against mail theft and allow delivery of parcels into the interior of the mailbox without security credentials, wherein the mailbox comprises walls and a floor that define an opening at an end of the mailbox, wherein a front door is affixed to said mailbox proximate to the opening, the opening providing full access to the interior compartment of the mailbox when the front door is in an open position, comprising the steps of: (1) connecting a bracket to the floor proximate to the opening; (2) connecting a reinforcing band to the walls and the bracket proximate the opening, the band comprising a second lock member proximate to the opening and disposed opposite the floor; (3) connecting a rotatable security panel to the band proximate to the opening, the security panel comprising: (a) a peripheral shape conforming to the interior dimensions of the opening generally defined by the walls and the floor; (b) a first lock member connected to the security panel proximate to a top edge opposite the floor, the first lock member adapted to lock the security panel to the second lock member; and (c) a door latch connected to the security panel proximate to the top edge, the door latch adapted to interconnect to the second lock member; and (4) attaching a pulling member to one of the front door or the security panel, the pulling member configured to demountably couple the front door to the security panel; wherein the security panel is rotated open when the front door is rotated opened; and wherein the security panel is locked when rotated to a vertical position. In another embodiment, the security panel comprises a spring member configured to rotate the security panel towards the front door.

Another embodiment of a method of field modification of a mailbox to protect against mail theft and allow delivery of parcels into the interior of the mailbox without security credentials, comprising the steps of: (1) connecting a rotatable security panel proximate to the opening, the security panel comprising: (a) a peripheral shape conforming to the interior dimensions of the opening generally defined by the walls and the floor; (b) a first lock member connected to the security panel proximate to a top edge opposite the floor; and (c) a spring member configured to rotate the security panel towards the front door; and (2) attaching a second lock member to the walls of the mailbox opposite the floor and proximate the opening, the second lock member configured to interlock to the first lock member; wherein the security panel is rotated open when the front door is rotated opened; and wherein the security panel is locked when rotated to a vertical position.

Methods of Use

Figure 13:
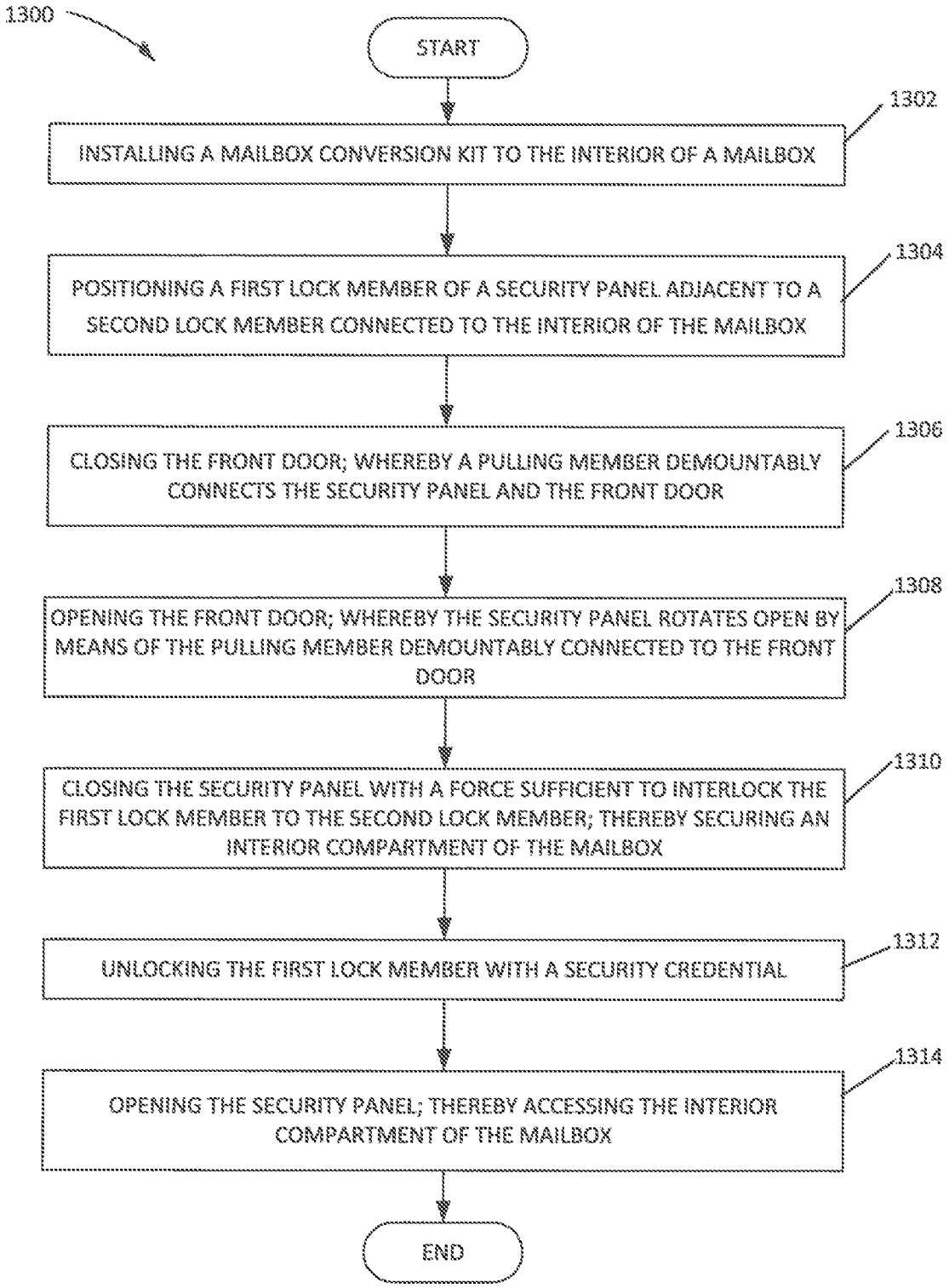
FIG. 13 is a flow chart illustrating a method of an embodiment of the disclosed subject matter.

In some embodiments, and referring to flow chart 1300 of FIG. 13, a method of using a field-modified mailbox. The method includes, at block 1302, installing a mailbox conversion kit to a mailbox, wherein the mailbox comprises a set of walls and a floor that define an opening at an end of the mailbox, wherein a front door is affixed to said mailbox proximate to the opening, the opening providing full access to the interior compartment of the mailbox when the front door is in an open position, the conversion kit comprising: (1) a security panel comprising a peripheral shape conforming to the interior dimensions of the opening defined by the set of walls and the floor, and a hinge piece comprising a first hinge portion adapted to be connected to the floor of the mailbox proximate to the opening, and a second hinge portion hingedly coupled to a first edge of the security panel, wherein the security panel provides access to the interior compartment of the mailbox through rotation of the hinge piece; (2) at least one first securing member configured to connect the first hinge portion to the floor; (3) a first lock member connected to the security panel proximate a second edge opposite the first edge of the security panel; (4) a pulling member demountably coupled between the front door and the security panel, whereby the pulling member urges the security panel open when the front door is moved away from the opening; (5) a second lock member connected to an interior wall of the mailbox proximate to said opening, the second lock member configured to interlock with first lock member when the security panel is in a vertical position; and (6) at least one second securing member for securing the second lock member to the set of walls.

The method further includes, at block 1304, positioning the first lock member of the security panel adjacent to the second lock member; wherein the first lock member does not interlock with the second lock member. The method further includes, at block 1306, closing the front door, whereby the pulling member demountably connects the security panel to the front door. The method further includes, at block 1308, opening the front door, whereby the security panel rotates open by means of the pulling member demountably connected to the front door. The method further includes, at block 1310, closing the security panel with a force sufficient to interlock the first lock member to the second lock member, thereby securing an interior compartment of the mailbox. The method further includes, at block 1312, unlocking the first lock member with a security credential. The method further includes, at block 1314, opening the security panel; thereby accessing the interior compartment of the mailbox.

Figure 14:
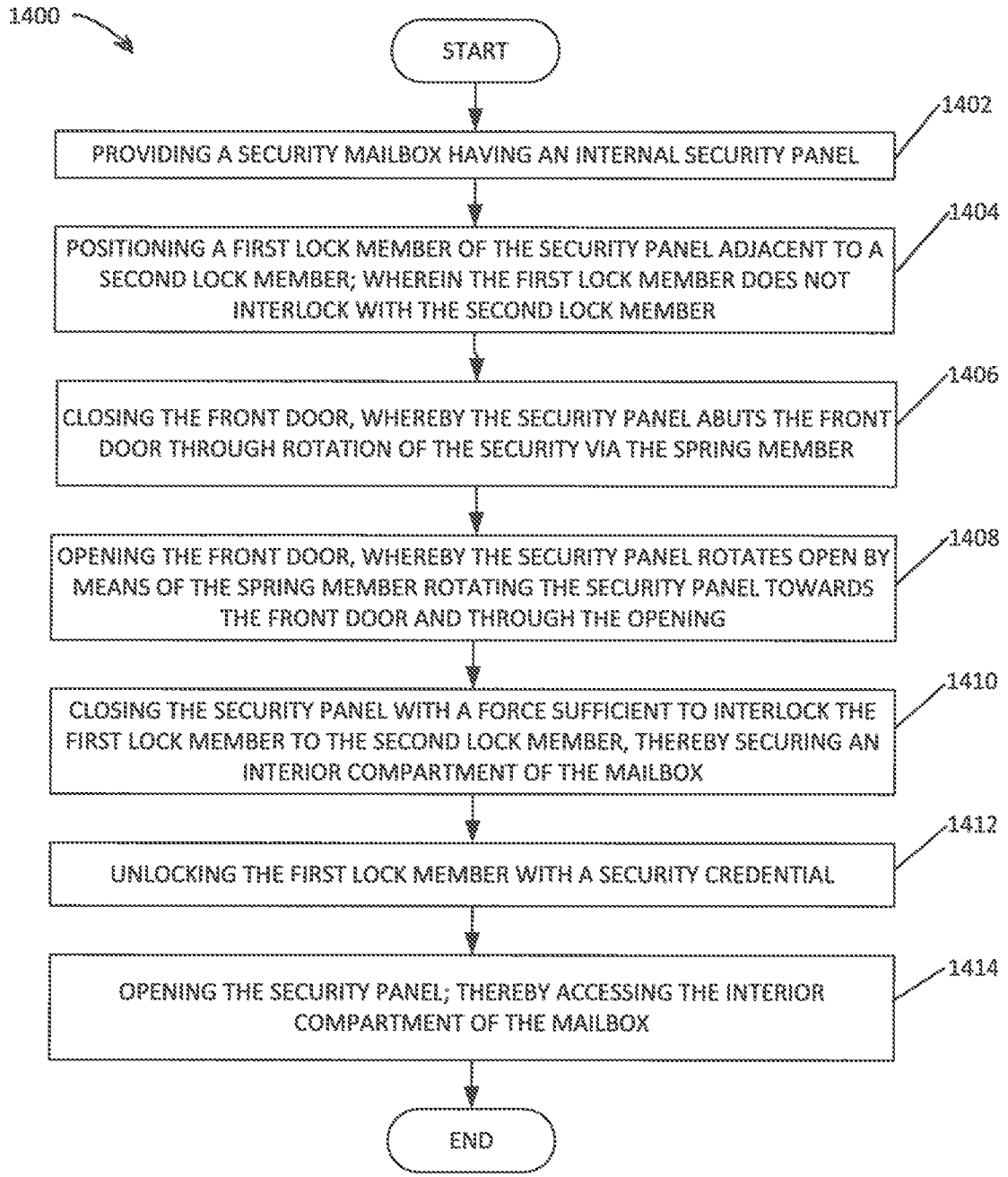
FIG. 14 is a flow chart illustrating a method of an embodiment of the disclosed subject matter.

In some embodiments, and referring to flow chart 1400 of FIG. 14, a method of using a security mailbox. The method includes, at block 1402, providing a security mailbox comprising a mailbox comprising: a set of walls and a floor that define an opening at an end of the mailbox, wherein a front door is affixed to said mailbox proximate to the opening, the opening providing full access to the interior compartment of the mailbox when the front door is in an open position; a security panel hingedly connected to the floor, the security panel comprising a peripheral shape conforming to the interior dimensions of the opening defined by the set of walls and the floor; a spring member connected between the front door and floor, the spring member configured to rotate the security panel towards the front door when unlocked, wherein the security panel provides access to the interior compartment of the mailbox through rotation of the security panel through the opening; and a first lock member connected to the security panel opposite the floor; and a second lock member connected to an interior wall of the mailbox proximate to said opening, the second lock member configured to interlock with first lock member when the security panel is in a vertical position.

The method further includes, at block 1404, positioning the first lock member of the security panel adjacent to the second lock member; wherein the first lock member does not interlock with the second lock member. The method further includes, at block 1406, closing the front door, whereby the security panel abuts the front door through rotation of the security via the spring member. The method further includes, at block 1408, opening the front door, whereby the security panel rotates open by means of the spring member rotating the security panel towards the front door and through the opening. The method further includes, at block 1410, closing the security panel with a force sufficient to interlock the first lock member to the second lock member, thereby securing an interior compartment of the mailbox. The method further includes, at block 1412, unlocking the first lock member with a security credential. The method further includes, at block 1414, opening the security panel; thereby accessing the interior compartment of the mailbox.

From the foregoing, those skilled in the art will recognize that the disclosed subject matter provide significant advantages to the field of mailbox security; in particular providing security mailboxes, conversions kits, and methods of installation thereof, for field-modification of a mailbox to protect against mail theft and allowing access for delivery of parcels into the interior of the mailbox. It is to be understood that while certain aspects of the disclosed subject matter have been shown and described, the disclosed subject matter is not limited thereto and encompasses various other embodiments and aspects.

It is to be understood that while certain aspects of the disclosed subject matter have been shown and described, the disclosed subject matter is not limited thereto and encompasses various other embodiments and aspects.

Having described the disclosed subject matter, what is claimed as new and desired to be secured by Letters Patent is:

1. A kit for field-modification of a mailbox to protect against mail theft, wherein the mailbox comprises a set of walls and a floor that define an opening at an end of the mailbox, wherein a front door is affixed to said mailbox proximate to the opening, the opening providing full access to a secure interior compartment of the mailbox when the front door is in an open position, the kit comprising:

a security panel comprising:

a peripheral shape conforming to the interior dimensions of the opening defined by the set of walls and the floor; and a hinge piece comprising a first hinge portion adapted to be secured to the floor of the mailbox proximate to the opening, and a second hinge portion hingedly coupled to a first edge of the security panel, wherein the security panel provides access to the interior compartment of the mailbox through rotation of the hinge piece;

at least one first securing member configured to connect the first hinge portion to the floor;

a first lock member connected to the security panel proximate a second edge opposite the first edge of the security panel;

a pulling member demountably coupled between the front door and the security panel, whereby the pulling member urges the security panel open when the front door is rotated away from the opening;

a second lock member connected to the set of walls proximate to said opening, the second lock member configured to interlock with first lock member; and at least one second securing member configured to connect the second lock member to the set of walls; and, wherein, when the kit is installed in the mailbox, the secure interior compartment for receiving deposited mail articles is substantially bounded by the security panel, the set of walls, and the floor rearward of the security panel, thereby allowing substantially the full volume of the mailbox behind the security panel to hold deposited mail articles.

2. The kit for field-modification of a mailbox of claim 1, wherein the pulling member is connected to one of an interior surface of the front door and an exterior surface of the security panel.

3. The kit for field-modification of a mailbox of claim 2, wherein the pulling member comprising a magnetic member configured to demountably connect the front door and the security panel; whereby the security panel is urged open when the front door is opened.

4. The kit for field-modification of a mailbox of claim 1, wherein the pulling member is connected to the front door, and the pulling member is configured to engage the security panel through a slot in the security panel; whereby the security panel is urged open when the front door is opened.

5. The kit for field-modification of a mailbox of claim 4, wherein the slot is bounded by a set of tabs extending away from the security panel.

6. The kit for field-modification of a mailbox of claim 1, wherein the kit further comprising a reinforcing band configured to connect to the set of walls and the floor of the mailbox proximate to the opening.

7. The kit for field-modification of a mailbox of claim 6, wherein the reinforcing band comprising a set of interlocking flat sections.

8. The kit for field-modification of a mailbox of claim 1, wherein the kit further comprising a bottom plate connected between the security panel and the floor.

9. The kit for field-modification of a mailbox of claim 8, wherein the bottom plate abuts a front edge of the floor.

10. The kit for field-modification of a mailbox of claim 1, wherein the first lock member comprising a spring latch configured to engage the second lock member; whereby the interior compartment is secured when the spring latch engages the second locking member.

11. The kit for field-modification of a mailbox of claim 10, wherein the first lock member comprising a security access point configured to unlock the security panel.

12. The kit for field-modification of a mailbox of claim 10, wherein the first lock member further comprising a door latch configured to interlock with the second lock member; thereby vertically restraining the set of walls and the security panel.

13. The kit for field-modification of a mailbox of claim 12, wherein the second lock member comprising a first edge and a second edge, the first edge parallel to the second edge; wherein the spring latch is configured to engage the first edge; wherein the door latch is configured to interlock with the second edge.

14. A security mailbox comprising:

a mailbox, wherein the mailbox comprises a set of walls and a floor that define an opening at an end of the mailbox, wherein a front door is affixed to said mailbox proximate to the opening, the opening providing full access to a secure interior compartment of the mailbox when the front door is in an open position;

a security panel hingedly connected to the floor, the security panel comprising:

a peripheral shape conforming to the interior dimensions of the opening defined by the set of walls and the floor;

a first lock member connected to the security panel opposite the floor; and one of a spring member connected between the front door and floor, and a pulling member demountably coupled between the front door and the security panel; and a second lock member connected to an interior wall of the mailbox proximate to said opening, the second lock member configured to interlock with first lock member when the security panel is in a vertical position;

wherein the secure interior compartment for receiving deposited mail articles is substantially bounded by the security panel, the set of walls, and the floor rearward of the security panel, thereby allowing substantially the full volume of the mailbox behind the security panel to hold deposited mail articles.

15. The security mailbox of claim 14, wherein the spring member comprises one of an elongated spring disposed internal to a hinge piece connected between the security panel and floor and a set of springs.

16. The security mailbox of claim 14, wherein the pulling member is connected to the front door, the pulling member is configured to engage the security panel through a slot in the security panel; whereby the security panel is urged open when the front door is opened.

17. A method of using a field-modified mailbox comprising the steps of:

providing a field-modified mailbox, wherein the mailbox comprises a set of walls and a floor that define an opening at an end of the mailbox, wherein a front door is affixed to said mailbox proximate to the opening, an opening providing full access to the interior compartment of the mailbox when the front door is in an open position, wherein the conversion kit comprising:

a security panel comprising a peripheral shape conforming to the interior dimensions of the opening defined by the set of walls and the floor, and a hinge piece comprising a first hinge portion adapted to be connected to the floor of the mailbox proximate to the opening, and a second hinge portion hingedly coupled to a first edge of the security panel, wherein the security panel provides access to the interior compartment of the mailbox through rotation of the hinge piece;

at least one first securing member configured to connect the first hinge portion to the floor;

a first lock member connected to the security panel proximate a second edge opposite the first edge of the security panel;

a pulling member demountably coupled between the front door and the security panel, whereby the pulling member urges the security panel open when the front door is moved away from the opening;

a second lock member connected to an interior wall of the mailbox proximate to said opening, the second lock member configured to interlock with first lock member when the security panel is in a vertical position; and at least one second securing member for securing the second lock member to the set of walls;

positioning the first lock member of the security panel adjacent to the second lock member; wherein the first lock member does not interlock with the second lock member;

closing the front door, whereby the pulling member demountably connects the security panel and the front door; and opening the front door, thereby opening the security panel by means of the pulling member connected between the front door and the security panel.

18. The method of using a field-modified mailbox of claim 17, further comprising the step of closing the security panel with a force sufficient to interlock the first lock member to the second lock member, thereby securing the interior compartment of the mailbox.

19. The method of using a field-modified mailbox of claim 18, further comprising the steps:

unlocking the first lock member with a security credential; and opening the security panel; thereby accessing the interior compartment of the mailbox.

20. The method of using a field-modified mailbox of claim 17, wherein the pulling member is configured to engage the security panel through a slot in the security panel.

* * * * *